US009999967B2

(12) United States Patent
Furusawa et al.

(10) Patent No.: US 9,999,967 B2
(45) Date of Patent: Jun. 19, 2018

(54) STRIKING TOOL

(75) Inventors: Masanori Furusawa, Anjo (JP); Yoshihiro Kasuya, Anjo (JP); Hajime Takeuchi, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 590 days.

(21) Appl. No.: 13/395,569

(22) PCT Filed: Oct. 22, 2010

(86) PCT No.: PCT/JP2010/068749

§ 371 (c)(1),
(2), (4) Date: May 11, 2012

(87) PCT Pub. No.: WO2011/077824

PCT Pub. Date: Jun. 30, 2011

(65) Prior Publication Data

US 2012/0279740 A1 Nov. 8, 2012

(30) Foreign Application Priority Data

Dec. 25, 2009 (JP) ..... 2009-295405

(51) Int. Cl.
*B25D 17/20* (2006.01)
*B25D 17/04* (2006.01)

(52) U.S. Cl.
CPC ..... *B25D 17/043* (2013.01); *B25D 2222/57* (2013.01); *B25D 2250/041* (2013.01);
(Continued)

(58) Field of Classification Search
CPC ..... B25D 17/043; B25D 17/24; B25D 16/00; B25D 2222/57; B25D 2250/245;
(Continued)

(56) References Cited

U.S. PATENT DOCUMENTS 4,478,293 A 10/1984 Weilenmann et al.
4,749,049 A 6/1988 Greppmair
(Continued)

FOREIGN PATENT DOCUMENTS

CN 1822925 A 8/2006
EP 1 752 257 A2 2/2007
(Continued)

OTHER PUBLICATIONS

Aug. 14, 2012 International Preliminary Report on Patentability issued in Application No. PCT/JP2010/068749.
(Continued)

*Primary Examiner* — Andrew M Tecco
*Assistant Examiner* — Chelsea Stinson
(74) *Attorney, Agent, or Firm* — Oliff PLC

(57) ABSTRACT

A technique for making a handle vibration-proof while avoiding size increase is provided in an impact tool. The impact tool has a striking mechanism part for driving a tool bit in its axial direction, a motor for driving the striking mechanism part, a tool body housing the motor and striking mechanism part, an outer shell housing covering part of the tool body, a handle that is integrally formed with the outer shell housing and extends transversely to the axial direction, a first handle end portion formed on one extending end of the handle, a second handle end portion formed on the other extending end of the handle, a first elastic element that connects the first handle end portion and tool body for relative movement in the axial direction, and a second elastic element that connects the second handle end portion and tool body for relative movement in the axial direction.

5 Claims, 7 Drawing Sheets

(52) U.S. Cl.
CPC .. *B25D 2250/121* (2013.01); *B25D 2250/245* (2013.01); *B25D 2250/371* (2013.01); *B25D 2250/381* (2013.01)

(58) Field of Classification Search
CPC ..... B25D 2250/371; B25D 17/046; B25D 2250/121; B25F 5/006; B25F 5/026
USPC ..... 173/162.2, 162.1, 217, 201, 210
See application file for complete search history.

(56) References Cited

U.S. PATENT DOCUMENTS

| | | | | |
|---|---|---|---|---|
| 5,400,860 | A * | 3/1995 | Best | B25D 17/24 173/162.2 |
| 5,697,456 | A | 12/1997 | Radle et al. | |
| 6,076,616 | A * | 6/2000 | Kramp | B25D 17/043 173/162.2 |
| 6,148,930 | A | 11/2000 | Berger et al. | |
| 7,017,680 | B2 * | 3/2006 | Arich | B23Q 1/0009 173/171 |
| 7,331,408 | B2 * | 2/2008 | Arich | B25D 16/00 173/201 |
| 7,523,790 | B2 * | 4/2009 | Arakawa | B25D 17/043 173/162.1 |
| 7,591,325 | B2 * | 9/2009 | Robieu | B25D 17/043 173/162.2 |
| 7,705,497 | B2 * | 4/2010 | Arich | B25D 16/00 173/117 |
| 8,091,651 | B2 | 1/2012 | Kuhnle et al. | |
| 8,403,076 | B2 | 3/2013 | Iwakami | |
| 8,579,043 | B2 * | 11/2013 | Hirayama | B25F 5/02 173/109 |
| 8,939,231 | B2 | 1/2015 | Roberts et al. | |
| 2004/0124721 | A1 * | 7/2004 | Pfisterer | B25D 17/20 310/51 |
| 2004/0177981 | A1 | 9/2004 | Berger | |
| 2004/0211575 | A1 * | 10/2004 | Soika | B25D 17/00 173/48 |
| 2006/0011365 | A1 | 1/2006 | Stirm et al. | |
| 2006/0219418 | A1 | 10/2006 | Arakawa et al. | |
| 2007/0034396 | A1 | 2/2007 | Berger et al. | |
| 2007/0034397 | A1 | 2/2007 | Fischer et al. | |
| 2007/0044984 | A1 * | 3/2007 | Fischer | B25D 17/043 173/217 |
| 2008/0047724 | A1 | 2/2008 | Fischer et al. | |
| 2009/0148246 | A1 * | 6/2009 | Nishikawa et al. | 408/58 |
| 2009/0266571 | A1 * | 10/2009 | Baumann et al. | 173/162.2 |
| 2009/0314507 | A1 | 12/2009 | Iwakami | |
| 2010/0018734 | A1 | 1/2010 | Frauhammer et al. | |

FOREIGN PATENT DOCUMENTS

| | | | |
|---|---|---|---|
| EP | 2 415 563 | A1 | 2/2012 |
| JP | U-54-89699 | | 6/1979 |
| JP | A-10-217065 | | 8/1998 |
| JP | A-2003-165073 | | 6/2003 |
| JP | A-2006-272511 | | 10/2006 |
| JP | A-2007-44869 | | 2/2007 |
| JP | 2008161036 | A | 7/2008 |
| JP | A-2009-241158 | | 10/2009 |

OTHER PUBLICATIONS

Feb. 1, 2011 International Search Report issued in International Patent Application No. PCT/JP2010/068749 (with translation).
Chinese Office Action issued in Chinese Patent Application No. 201080058098.6 dated Sep. 4, 2014 (with translation).
Russian Office Action issued in Russian Patent Application No. 2012131749 dated Oct. 21, 2014 (with translation).
Jan. 28, 2014 Extended European Search Report issued in European Patent Application No. 10839061.8.
Feb. 19, 2015 Office Action issued in Russian Application No. 2012 131 749.
Dec. 31, 2015 Office Action issued in U.S. Appl. No. 14/854,869.
Sep. 2, 2013 Office Action issued in Japanese Patent Application No. 2009-295405.
Aug. 26, 2016 Office Action Issued in U.S. Appl. No. 14/854,869.
Feb. 8, 2017 Office Action issued in U.S. Appl. No. 14/854,869.
Jun. 29, 2017 Office Action issued in U.S. Appl. No. 14/854,869.

* cited by examiner

STRIKING TOOL

FIELD OF THE INVENTION

The present invention relates to an impact striking tool which performs a predetermined hammering operation by causing a tool bit to linearly move in an axial direction of the tool bit.

BACKGROUND OF THE INVENTION

Japanese laid-open Patent Publication No. 2003-165073 discloses a vibration-proof housing structure of an impact tool in the form of an electric hammer. In this electric hammer, an outer housing which forms an outer shell of the electric hammer and is integrally provided with a handle to be held by a user is connected via an elastic member to a tool body (an inner housing) which houses a striking mechanism part for striking a hammer bit. With such a construction, vibration caused during hammering operation can be reduced.

According to the above-described construction, transmission of vibration caused in the striking mechanism part to the handle can be reduced, but with the construction in which the outer housing entirely covers the inner housing including the motor housing, the electric hammer is increased in size. In this point, further improvement is required.

DISCLOSURE OF THE INVENTION

Object of the Invention

Accordingly, it is an object of the present invention to provide an impact tool which is improved to reduce the size of the entire impact tool while maintaining the vibration-proof effect of the handle.

Means for Achieving the Object

In order to achieve the above-described object, according to a preferred embodiment of the present invention, an impact tool has a striking mechanism part, a motor, a tool body, an outer shell housing, a handle, first and second handle end portions and first and second elastic elements. Further, the "impact tool" in this invention suitably includes a hammer in which a tool bit is caused to linearly move in its axial direction, and a hammer drill in which the tool bit is caused to linearly move in its axial direction and rotate around its axis.

According to the preferred embodiment of this invention, the striking mechanism part strikes a tool bit in an axial direction of the tool bit. The motor drives the striking mechanism part and is disposed such that a rotation axis of the motor runs transversely to the axial direction of the tool bit. The tool body houses the motor and the striking mechanism part and has a front end region to which the tool bit is coupled. The outer shell housing covers part of the tool body. The "part of the tool body" here typically represents a region which houses the striking mechanism part of the tool body. The handle is integrally formed with the outer shell housing on the side opposite from the tool bit. The manner of "being integrally formed" here suitably includes both the manner in which the handle and the outer shell housing are integrally formed with each other and the manner in which the outer shell housing and the handle are separately formed and thereafter connected to each other. The first handle end portion is formed on one extending end of the handle, and the second handle end portion is formed on the other extending end of the handle. The first elastic element is disposed between the first handle end portion and the tool body and connects the first handle end portion and the tool body such that the first handle end portion and the tool body can move in the axial direction of the tool bit with respect to each other. The second elastic element is disposed between the second handle end portion and the tool body and connects the second handle end portion and the tool body such that the second handle end portion and the tool body can move in the axial direction of the tool bit with respect to each other. Each of the "first and second elastic elements" in this invention typically represents a compression coil spring, but suitably includes a leaf spring, torsion spring or rubber.

According to this invention, with the construction in which the handle integrally formed with the outer shell housing is connected to the tool body via the first and second elastic elements such that the handle can move with respect to the outer shell housing, the handle integrated with the outer shell housing can be made proof against vibration. Further, according to this invention, with the construction in which the outer shell housing covers part of the tool body, the impact tool can be reduced in size by reducing an area of a double housing structure while providing the vibration-proofing structure of the handle.

According to a further embodiment of this invention, the impact tool further has an outer shell housing front end region defined as a region of the outer shell housing close to the tool bit, an auxiliary handle mounting part provided on an outer surface of the outer shell housing front end region, and an auxiliary handle which can be mounted to the auxiliary handle mounting part.

According to this invention, the auxiliary handle which is provided separately from the handle integrally formed with the outer shell housing can also have the same vibration-proof effect as the handle.

According to a further embodiment of this invention, the first elastic element is located closer to an axis of the tool bit than the second elastic element, and has a larger elastic constant than the second elastic element.

The operation (hammering operation) by using the impact tool is performed with the tool bit pressed against a workpiece. Therefore, by provision of the first elastic element located closer to the axis of the tool bit and having a larger elastic constant than the second elastic element, the operation of pressing the tool bit against the workpiece can be performed with stability.

According to a further embodiment of this invention, the first and second elastic elements have the same specifications, and the first elastic element closer to the axis of the tool bit is mounted under a heavier initial load than the second elastic element. With such a construction, like in the above-described construction in which the first and second elastic elements have different spring constants, the operation of pressing the tool bit against the workpiece can be performed with stability. The state of the elastic element "under an initial load" here represents the state in which the elastic element is compressed by application of a load in the direction of compression in a stationary condition.

According to a further embodiment of this invention, the impact tool further has an outer shell housing front end region which is defined as a region of the outer shell housing close to the tool bit, a tool body front end region which is defined as a region of the tool body covered by the outer shell housing front end region, and a third elastic element which is disposed between an inner peripheral surface of the outer shell housing front end region and an outer peripheral surface of the tool body front end region and connects the outer shell housing front end region and the tool body front end region such that they can move with respect to each other. The "third elastic element" in this invention typically represents an elastic ring-like member, but it also suitably includes a plurality of elastic elements disposed at predetermined intervals in the circumferential direction.

According to this invention, the outer shell housing front end region can be positioned in the radial direction with respect to the tool body front end region by the third elastic element.

According to a further embodiment of this invention, the third elastic element comprises a plurality of elastic receivers which are disposed at predetermined intervals in a circumferential direction and held in contact with an inner peripheral surface of the outer shell housing front end region and an outer peripheral surface of the tool body front end region. The "plurality of elastic receivers" in this invention may be connected to each other into a ring form, or they may be disposed separately from each other. According to this invention, a communication passage can be formed between the adjacent elastic receivers such that spaces on the both sides of the elastic element between the outer peripheral surface of the tool body and the inner peripheral surface of the outer shell housing communicate with each other in the longitudinal direction via the communication passage. Specifically, according to this invention, the cooling air passage can be rationally formed such that air is taken in through an inlet or an open front end of the outer shell housing and led rearward through the cooling air passage in order to cool the driving mechanism and the motor within the tool body, while elastically supporting the outer shell housing with respect to the tool body.

According to a further embodiment of this invention, the impact tool further includes a controller for controlling the motor, and the tool body has a covering member which houses the motor controlling controller. Specifically, in this invention, with the construction in which the tool body has the covering member and the motor controlling controller is housed within the covering member, the covering member does not have to be provided with a space for avoiding interfering with the controller due to relative movement of the tool body and the outer shell housing. Thus, the covering member can be reduced in size, and the controller can be easily protected from vibration.

According to a further embodiment of this invention, the impact tool further includes a dust collecting passage through which dust generated by an operation is transferred downstream. Further, the tool body has a motor housing part which houses the motor, and a covering member which is fastened to the motor housing part and covers part of the motor housing part, and the dust collecting passage is disposed within the motor housing part and the covering member.

According to this invention, the dust collecting passage can be fixed to the motor housing part and the covering member. Therefore, the motor housing part and the covering member do not have to be provided with a space for avoiding interfering with the dust collecting passage due to relative movement of the tool body and the outer shell housing. Thus, the motor housing part and the covering member can be reduced in size.

According to a further embodiment of this invention, the impact tool further has first and second plate-like members and a connecting member which connects the first and second plate-like members such that they can move with respect to each other in a direction in which a distance between the opposed plate-like members changes. Further, the second elastic element more distant from the axis of the tool bit than the first elastic element is disposed between the first and second plate-like members in advance, and the first and second plate-like members are connected by the connecting member, so that an assembly structure is formed. The assembly structure is disposed between the handle and the tool body, and the first and second plate-like members are fastened to the handle and the tool body, respectively.

According to this invention, by providing the second elastic element as a component of the assembly structure, ease of mounting the second elastic element to the tool body and the handle can be improved.

According to a further embodiment of this invention, the impact tool further has a dust collecting passage which is provided on the tool body side and through which dust generated by an operation is transferred downstream, and a dust discharge port is provided on the handle side. Further, the assembly structure has an opening which connects the dust collecting passage and the dust discharge port. With such a construction in which the opening for dust is provided in the assembly structure, the assembly structure can absorb relative movement of the dust collecting passage on the tool body side and the dust discharge port on the handle side which is caused by vibration.

Effect of the Invention

According to this invention, an impact tool is provided which is improved to reduce the size of the entire impact tool while maintaining the vibration-proof effect of the handle. Other objects, features and advantages of this invention will be readily understood after reading the following detailed description together with the accompanying drawings and the claims.

REPRESENTATIVE EMBODIMENT OF THE INVENTION

Each of the additional features and method steps disclosed above and below may be utilized separately or in conjunction with other features and method steps to provide improved impact tools and devices utilized therein. Representative examples of this invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
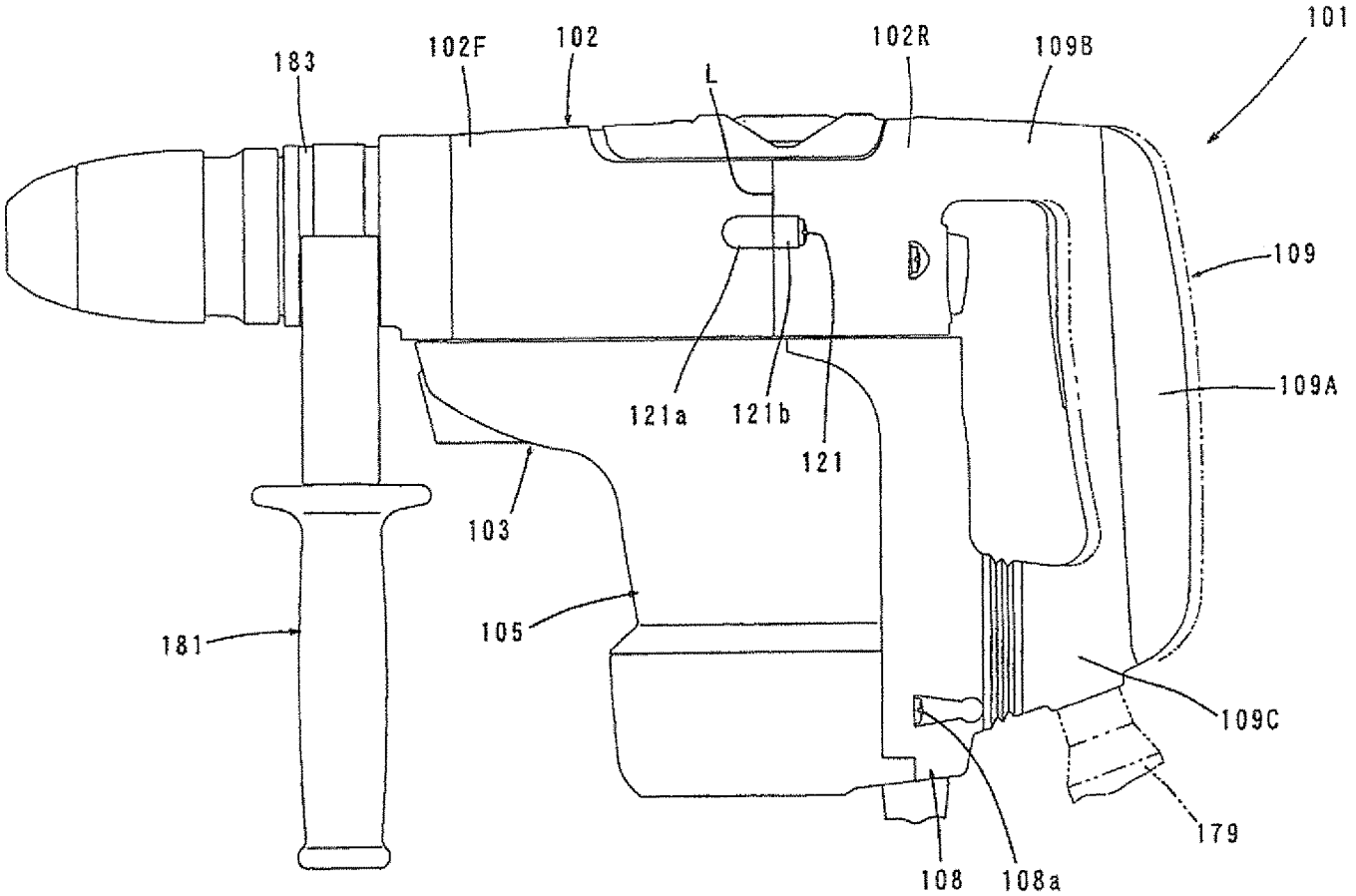
FIG. 1 is a side view showing an entire structure of a hammer drill according to an embodiment of this invention.
Figure 2:
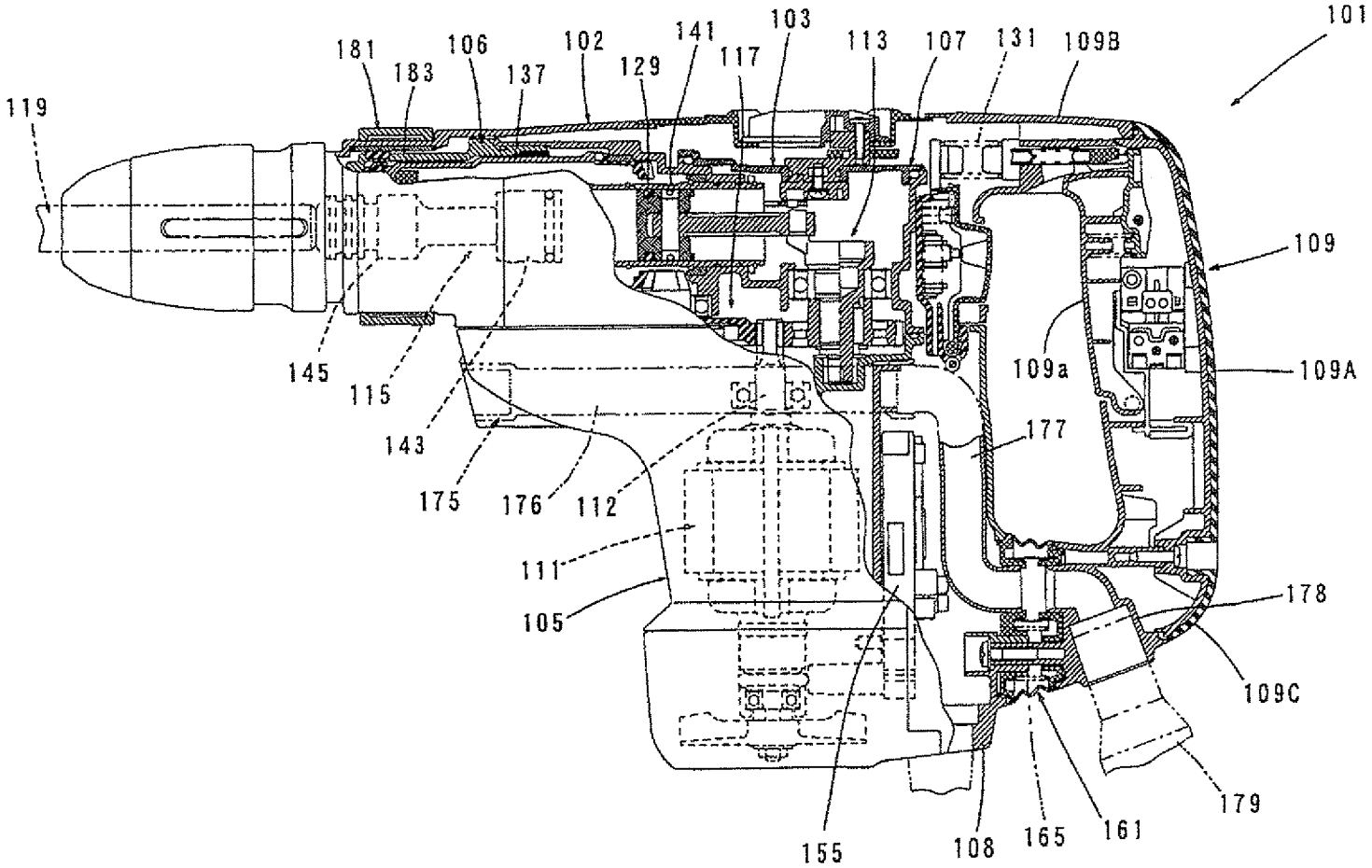
FIG. 2 is a cutaway side view of the hammer drill.

An embodiment of this invention is now described with reference to FIGS. 1 to 10. In this embodiment, an electric hammer drill is explained as a representative example of an impact tool. As shown in FIGS. 1 and 2, a hammer drill 101 according to this embodiment mainly includes an outer housing 102, a body 103 that is covered in part by the outer housing 102, a hammer bit 119 that is detachably coupled to a front end region (on the left as viewed in the drawings) of the body 103 via a hollow tool holder 137, and a handgrip 109 that is connected to the outer housing 102 on the side opposite from the hammer bit 119 and designed to be held by a user. The hammer bit 119 is held by the tool holder 137 such that it is allowed to linearly move in its axial direction with respect to the tool holder. The outer housing 102, the body 103, the hammer bit 119 and the handgrip 109 are features that correspond to the "outer shell housing", the "tool body", the "tool bit" and the "handle", respectively, according to this invention. Further, for the sake of convenience of explanation, the side of the hammer bit 119 is taken as the front and the side of the handgrip 109 as the rear, As shown in FIG. 2, the boy 103 includes a motor housing 105 that houses a driving motor 111, and a gear housing 107 including a barrel 106 that houses a motion converting mechanism 113, a striking mechanism 115 and a power transmitting mechanism 117. The motor housing 105 and the gear housing 107 are connected to each other by screws or other fastening means. The motor housing 105 is a feature that corresponds to the "motor housing part" according to this invention. The driving motor 111 is disposed such that an output shaft 112 (a rotation axis) of the motor runs in a vertical direction (vertically as viewed in FIG. 2) substantially perpendicular to a longitudinal direction of the body 103 (an axial direction of the hammer bit 119). The motion converting mechanism 113 appropriately converts torque of the driving motor 111 into linear motion and then transmits it to the striking mechanism 115. Then an impact force is generated in the axial direction of the hammer bit 119 (the horizontal direction as viewed in FIG. 2) via the striking mechanism 115. The motion converting mechanism 113 and the striking mechanism 115 are features that correspond to the "striking mechanism part" according to this invention. Therefore, the gear housing 107 including the barrel 106 forms the "striking mechanism part housing region". Further, the power transmitting mechanism 117 appropriately reduces the speed of torque of the driving motor 111 and transmits it to the hammer bit 119 via the tool holder 137, so that the hammer bit 119 is caused to rotate in a circumferential direction. The driving motor 111 is driven when a user depresses a trigger 109*a* disposed on the handgrip 109.

As shown in FIG. 2, the motion converting mechanism 113 mainly includes a crank mechanism. The crank mechanism includes a driving element in the form of a piston 129 which forms a final movable member of the crank mechanism. When the crank mechanism i s rotationally driven by the driving motor 111, the piston 135 is caused to linearly move in the axial direction of the hammer bit within a cylinder 141. The power transmitting mechanism 117 mainly includes a gear speed reducing mechanism having a plurality of gears and transmits torque of the driving motor 111 to the tool holder 137. Thus, the tool holder 137 is caused to rotate in a vertical plane and then the hammer bit 119 held by the tool holder 137 is also caused to rotate. Further, the constructions of the motion converting mechanism 113 and the power transmitting mechanism 117 are well known in the art and therefore their detailed description is omitted.

The striking mechanism 115 mainly includes a striking element in the form of a striker 143 that is slidably disposed within the bore of the cylinder 141 together with the piston 129, and an intermediate element in the form of an impact bolt 145 that is slidably disposed within the tool holder 137. The striker 143 is driven via air spring action (pressure fluctuations) of an air chamber of the cylinder 141 by sliding movement of the piston 129. The striker 143 then collides with (strikes) the impact bolt 145. As a result, a striking force caused by the collision is transmitted to the hammer bit 119 via the impact bolt 145.

The hammer drill 101 can be switched between hammer mode in which an operation is performed on a workpiece by applying only a striking force to the hammer bit 119 in the axial direction, and hammer drill mode in which an operation is performed on a workpiece by applying a striking force in the axial direction and a rotating force in the circumferential direction to the hammer bit 119. The operation mode switching between hammer mode and hammer drill mode is a known technique and not directly related to this invention, and therefore their detailed description is omitted.

In the hammer drill 101 constructed as described above, when the driving motor 111 is driven, the rotating output of the motor is converted into linear motion via the motion converting mechanism 113 and then causes the hammer bit 119 to perform linear movement or striking movement in the axial direction via the striking mechanism 115. Further, in addition to the above-described striking movement, rotation is transmitted to the hammer bit 119 via the power transmitting mechanism 117 which is driven by the rotating output of the driving motor 111. Thus, the hammer bit 119 is caused to rotate in the circumferential direction. Specifically, during operation in hammer drill mode, the hammer bit 119 performs striking movement in the axial direction and rotation in the circumferential direction, so that a hammer drill operation is performed on the workpiece. During operation in hammer mode, torque transmission of the power transmitting mechanism 117 is interrupted by a clutch (not shown). Therefore, the hammer bit 119 is caused to perform only striking movement in the axial direction, so that a hammering operation is performed on the workpiece.

During the above-described hammering or hammer drill operation, in the body 103, impulsive and cyclic vibration is mainly caused in the axial direction of the hammer bit 119. A vibration-proofing structure is now explained which serves to prevent or reduce transmission of vibration from the body 103 to the handgrip 109.

As shown in FIGS. 1 and 2, the outer housing 102 covers an upper region of the body 103, or the barrel 106 and the gear housing 107, which houses the striking mechanism part. The outer housing 102 is split into two parts, or a front part 102F and a rear part 102R. The front part 102F extends substantially horizontally in the axial direction of the hammer bit 119, and the rear part 102R extends rearward from a rear end of the front part 102F and has the handgrip 109 integrally formed on its rear end. A parting line (mating face) is shown and designated by L in FIG. 1. In the following description, the front part 102F is referred to as a front housing part and the rear part 102R as a rear housing part. In order to assemble the front and rear housing parts 102F, 102R together, mating faces L (a rear surface of the front housing part 102F and a front surface of the rear housing part 102R) are butted with each other, and in this state, a plurality of front and rear connecting bosses 121*a*, 121*b* formed on the outer peripheries of the front and rear housing parts are clamped and connected together by screws 121. The front housing part 102F is configured as a hollow member having open front and rear ends and a bottom which is open in other than its front end region, and arranged to cover the barrel 106 and part of the gear housing 107. Further, the rear housing part 102R is configured as a hollow member having open front and rear ends and an open bottom and arranged to cover the gear housing 107.

Figure 3:
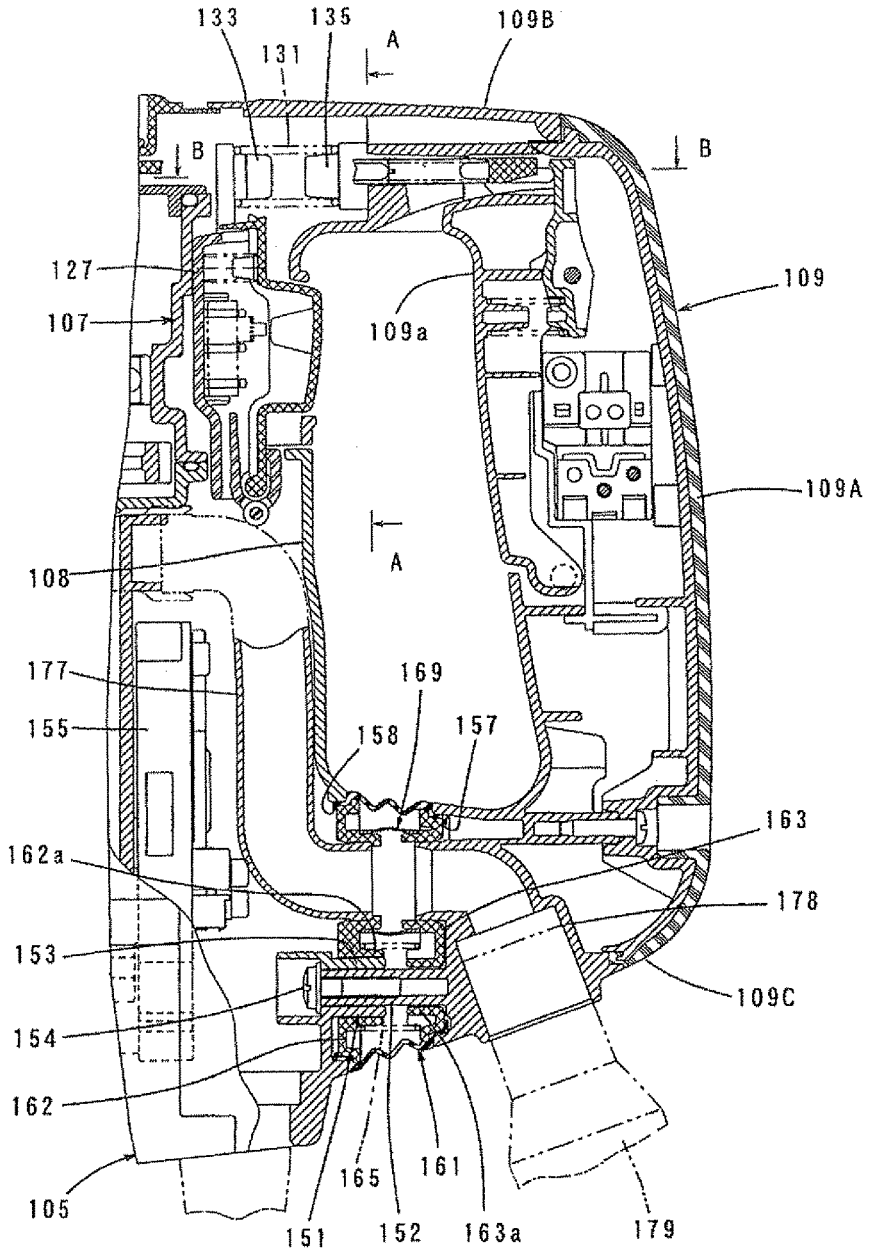
FIG. 3 is a partly enlarged view of FIG. 2.

As shown in FIGS. 1 to 3, the handgrip 109 is generally D-shaped as viewed from the side and has a hollow cylindrical grip region 109A extending in the vertical direction transverse to the axial direction of the hammer bit 119, and upper and lower connecting regions 109B, 109C extending substantially horizontally forward from upper and lower ends of the grip region 109A. The upper connecting region 109B and the lower connecting region 109C are features that correspond to the "first handle end portion" and the "second handle end portion", respectively, according to this invention.

In the handgrip 109 constructed as described above, the upper connecting region 109B is elastically connected to an upper portion of the rear surface of the gear housing 107 via a vibration-proofing first compression coil spring 131, and the lower connecting region 109C is elastically connected to a rear cover 108 of the motor housing 105 via a vibration-proofing second compression coil spring 165. Further, the front housing part 102F of the outer housing 102 is elastically connected to the barrel 106 via an elastic ring 171 (see FIG. 7). In this manner, the outer housing 102 including the handgrip 109 is elastically connected to the body 103 at a total of three points, or upper and lower ends of the grip region 109A of the handgrip 109 and a front end region of the front housing part 102F. With such a construction, the outer housing 102 can move in the axial direction of the hammer bit 119 with respect to the body 103. The first compression coil spring 131, the second compression coil spring 165 and the elastic ring 171 are features that correspond to the "first elastic element", the "second elastic element" and the "third elastic element", respectively, according to this invention.

Figure 4:
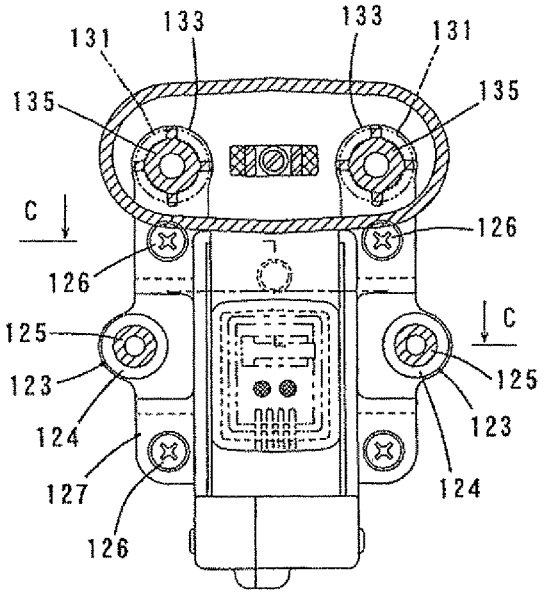
FIG. 4 is a sectional view taken along line A-A in FIG. 3.
Figure 6:
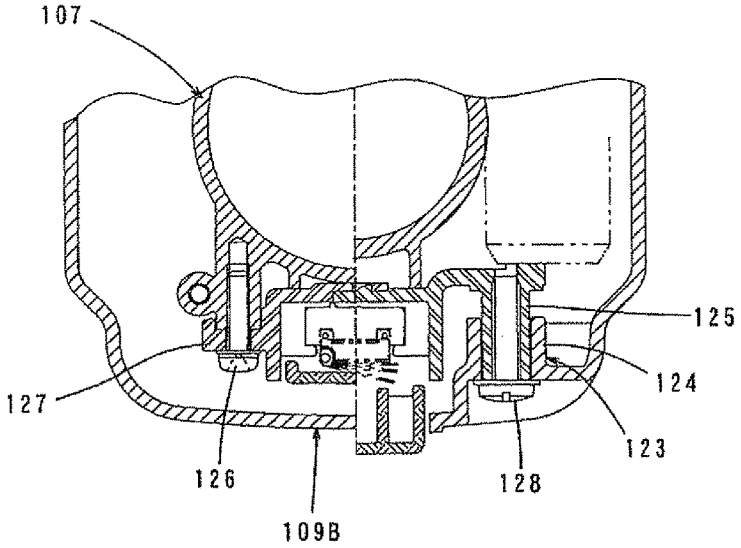
FIG. 6 is a sectional view taken along line C-C in FIG. 4.

The structure of each of elastic connecting parts of the outer housing 102 is now explained. The elastic connecting part of the upper connecting region 109B of the handgrip 109 mainly includes right and left slide guides 123 and right and left first compression coil springs 131. As shown in FIGS. 4 and 6, the slide guides 123 are symmetrically disposed below the axis of the hammer bit 119 with respect to this axis. Each of the two right and left slide guides 123 includes a cylindrical guide 124 integrally formed on an inner surface of the upper connecting region 109B, and a guide rod 125 provided on a fixed member 127 (a switch case for housing a switch for operation mode switching) which is fastened to the gear housing 107 by screws 126. The guide rod 125 is slidably fitted in a bore of the cylindrical guide 124. The upper connecting region 109B is supported by the slide guide 123 with respect to the gear housing 107 and can slide in the axial direction of the hammer bit. A screw 128 is threadably inserted into the guide rod 125 in the longitudinal direction until a head of the screw 128 comes in contact with an end surface of the cylindrical guide 124, so that the guide rod 125 is prevented from slipping out of the cylindrical guide 124.

Figure 5:
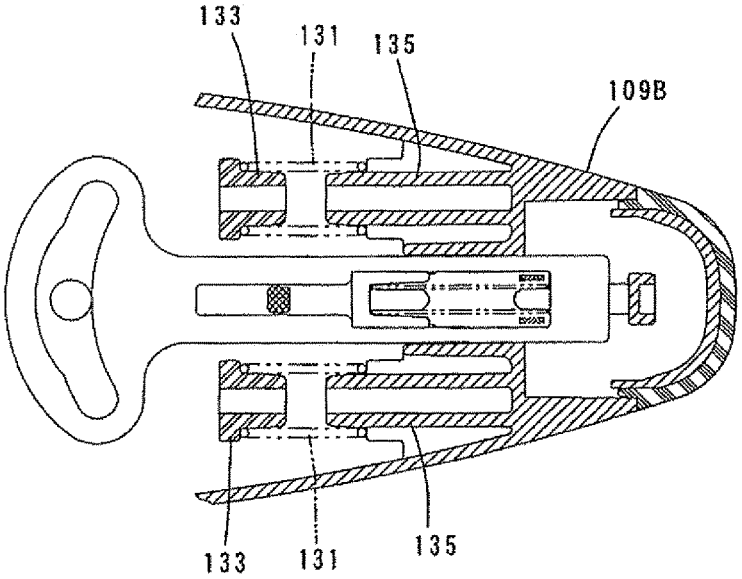
FIG. 5 is a sectional view taken along line B-B in FIG. 3.

As shown in FIGS. 4 and 5, the first compression coil springs 131 are symmetrically disposed above the axis of the hammer bit 119 with respect to this axis. Each of the right and left first compression coil springs 131 is disposed such that its central axis runs substantially in parallel to the axial direction of the hammer bit 119 and elastically disposed between a spring receiver 133 formed on the fixed member 127 and a spring receiver 135 formed on the inner surface of the upper connecting region 109B. Thus, the first compression coil spring 131 applies a rearward spring force to the handgrip 109. The spring constant of the first compression coil spring 131 is set to be higher than that of the second compression coil spring 165 which is described below.

An elastic connecting part of the lower connecting region 109C of the handgrip 109 mainly includes a slide guide 151 and an assembly structure 161 in which the second compression coil spring 165 is mounted in advance. As shown in FIG. 3, the slide guide 151 includes a cylindrical guide rod 152 and a cylindrical guide 153. The cylindrical guide rod 152 is integrally formed on a front end surface of the lower connecting region 109C and extends in the axial direction of the hammer bit 119. The cylindrical guide 153 is formed on the rear cover 108 of the motor housing 105 and the guide rod 152 is slidably fitted in the cylindrical guide 153. The lower connecting region 109C is supported by the slide guide 151 with respect to the rear cover 108 and can slide in the axial direction of the hammer bit. A screw 154 is threadably inserted into the guide rod 152 in the longitudinal direction until a head of the screw 154 comes in contact with an end surface of the cylindrical guide 153, so that the guide rod 152 is prevented from slipping out of the cylindrical guide 153. The rear cover 108 is provided and configured as a member for covering a rear region of the motor housing 105 and detachably fastened to the motor housing 105 by screws 108*a* (see FIG. 1). Further, the rear cover 108 houses a controller 155 for controlling the driving motor. The rear cover 108 is a feature that corresponds to the "covering member" according to this invention.

Figure 9:
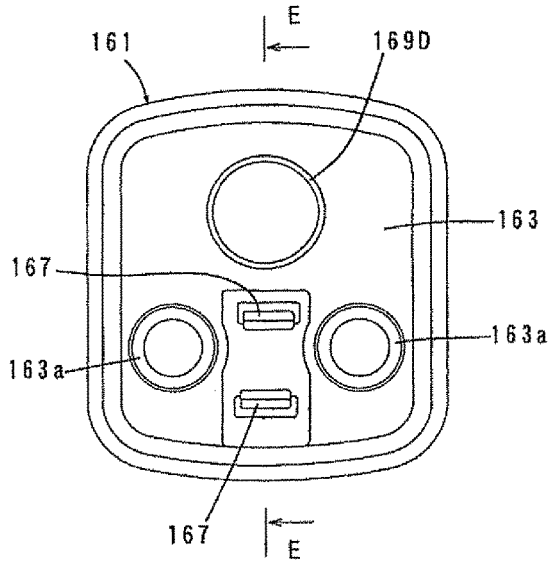
FIG. 9 is a front view showing an assembly structure.
Figure 10:
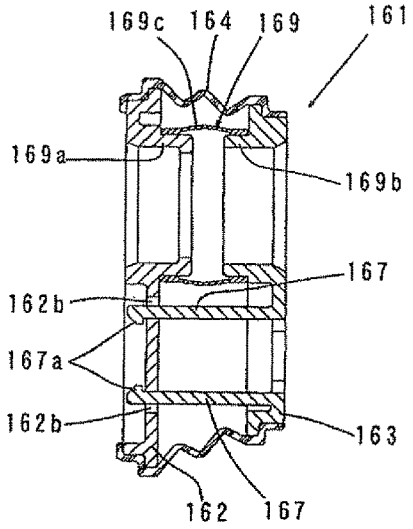
FIG. 10 is a sectional view taken along line E-E in FIG. 9.

As shown in FIGS. 3, 9 and 10, the assembly structure 161 mainly includes generally rectangular front and rear plates 162, 163 which are opposed to each other in the axial direction of the hammer bit 119 (in the longitudinal direction), a generally rectangular tubular bellows-like member 164 which connects the both plates 162, 163 such that they can move with respect to each other in a direction (the longitudinal direction) in which the distance between the opposed plates changes, and right and left second compression coil springs 165 which are disposed between the front and rear plates 162, 163. The front and rear plates 162, 163 and the bellows-like member 164 are features that correspond to the "first and second plate-like members" and the "connecting member", respectively, according to this invention.

As shown in FIG. 3, each of the right and left second compression coil springs 165 is received by the cylindrical spring receivers 162*a*, 163*a* which are formed on the opposed surfaces of the front and rear plates 162, 163, and applies a spring force to the both plates 162, 163 in the direction that widens the distance between the opposed plates 162, 163. Further, as shown in FIGS. 9 and 10, a pair of upper and lower engagement arms 167 are integrally formed with the rear plate 163 and protrude toward the front plate 162 between the right and left second compression coil springs 165. An engagement claw 167*a* formed on a protruding end of each of the engagement arms 167 is loosely inserted through a hole 162*b* in the front plate 162 and engaged with the edge of the hole. Thus, the front and rear plates 162, 163 are assembled together in a state in which a maximum distance between the opposed plates is defined, while being subjected to the spring force of the second compression coil spring 165. Further, the front and rear plates 162, 163 can move with respect to each other in the direction that narrows the distance between the opposed plates by compressing the second compression coil spring 165. In order to assemble the assembly structure 161, the bellows-like member 164 is fitted onto the outer edge of the both plates 162, 163 so as to cover an outer peripheral region of the front and rear plates 162, 163 between which the right and left second compression coil springs 165 are disposed. The front and rear plates 162, 163 thus assembled can move with respect to each other by expansion and compression of the right and left second compression coil springs 165 and the bellows-like member 164. Further, as shown in FIG. 3, bores of the cylindrical spring receivers 162*a*, 163*a* are designed as an installation space for the slide guide 151.

A pipe joint 169 is formed in the assembly structure 161 and forms part of a dust collecting passage 175 which is described below. The pipe joint 169 is formed on the front and rear plates 162, 163 and includes front and rear cylindrical parts 169*a*, 169*b* which are opposed to each other at predetermined spacing, and a flexible sleeve 169*c*. The flexible sleeve 169*c* is fitted on the front and rear cylindrical parts 169*a*, 169*b* and covers a region between the cylindrical parts in the circumferential direction. The pipe joint 169 allows the front and rear plates 162, 163 to move with respect to each other by elastic deformation of the sleeves 169*c*. Specifically, the assembly structure 161 is configured as an assembly including the second compression coil spring 165 and the pipe joint 169. The pipe joint 169 is a feature that corresponds to the "opening for connecting the dust collecting passage and the dust discharge port" according to this invention.

The assembly structure 161 constructed as described above is disposed between the lower connecting region 109C and the rear cover 108 of the motor housing 105. In order to mount the assembly structure 161, one end (right end as viewed in FIG. 3) of the bellows-like member 164 is fitted into a mounting opening 157 formed in the lower connecting region 109C, and the other end of the bellows-like member 164 is fitted into a mounting opening 158 formed in the rear cover 108. At this time, as for the slide guide 151, as shown in FIG. 3, the guide rod 152 of the lower connecting region 109C is inserted into the bore of the cylindrical guide 153 of the rear cover 108.

Figure 7:
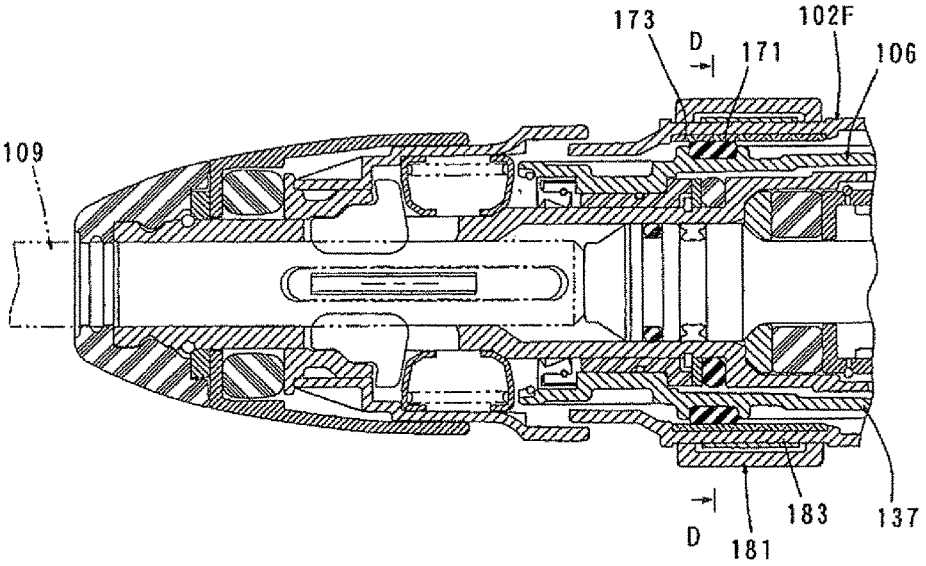
FIG. 7 is an enlarged sectional view showing part (the front end side) of FIG. 2.
Figure 8:
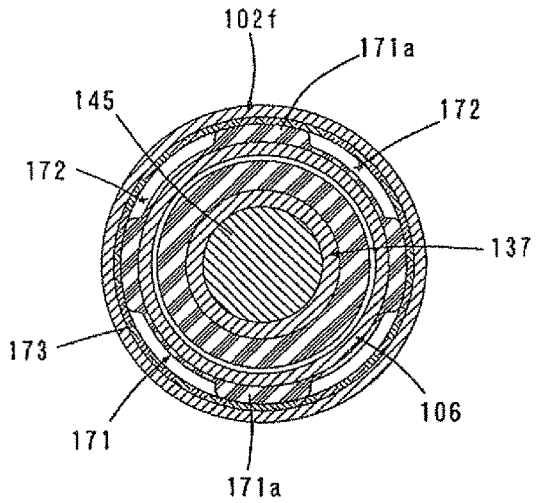
FIG. 8 is a sectional view taken along line D-D in FIG. 7.

The elastic connecting part of the front end region of the front housing part 102F mainly includes an elastic ring 171. As shown in FIGS. 7 and 8, a sleeve 173 is disposed between an inner surface of the front end region of the front housing part 102F of the outer housing 102 and an outer surface of the front end region of the barrel 106. The sleeve 173 is held in surface contact with the inner peripheral surface of the front end region of the front housing part 102F and elastically held in contact with the outer peripheral surface of the front end region of the barrel 106 via the elastic ring 171. The elastic ring 171 is made of rubber, and as shown in FIG. 8, the elastic ring 171 has a plurality of elastic receivers 171*a* formed at predetermined intervals in the circumferential direction. The elastic receivers 171*a* protrude radially outwardly from an outer surface of the elastic ring 171 and are held in contact with an inner peripheral surface of the sleeve 173. The outer housing 102 is positioned in the radial direction (in the direction transverse to the axial direction of the hammer bit 119) with respect to the barrel 106 by the elastic receivers 171*a*. Further, the outer housing 102 is allowed to move with respect to the barrel 106 by elastic deformation of the elastic receivers 171*a* in the axial direction of the hammer bit 119 and in the radial direction. Thus, the elastic ring 171 serves as a vibration-proofing member in the axial direction of the hammer bit 119 and the radial direction. An opening 172 is formed between adjacent ones of the elastic receivers 171*a* and surrounded by an outer surface of the elastic ring 171, an inner surface of the sleeve 173 and side surfaces of the elastic receivers 171*a*. The spaces on the both sides of the elastic ring 171 between the outer surface of the barrel 106 and the inner surface of the outer housing 102 covering the barrel 106 communicate with each other in the longitudinal direction (the axial direction of the hammer bit) via the openings 172. Specifically, when a cooling fan 114 (see FIG. 2) for cooling the driving motor 111 is driven, air is taken in through an inlet in the form of an opening of the front end of the outer housing 102 which is open on the outer surface side of the barrel 106, and then the air is led rearward through the space via the openings 172. Thus, the openings 172 form a cooling air passage. The air led through the inlet cools an area surrounding the barrel 106 and then flows rearward and cools the driving motor 111. Thereafter, the air is discharged to the outside of the motor housing 105. The front end region of the front housing part 102F and the front end region of the barrel 106 are features that correspond to the "outer shell housing front end region" and the "tool body front end region", respectively, according to this invention. Further, the elastic receivers 171*a* may be configured to protrude radially inward from an inner surface of the elastic ring 171.

A circular side grip mounting part 183 is formed on the outer surface of the front end region of the front housing part 102F which covers the front end region of the barrel 106, and a side grip 181 is detachably mounted to the side grip mounting part 183. The side grip mounting part 183 and the side grip 181 are features that correspond to the "auxiliary handle mounting part" and the "auxiliary handle", respectively, according to this invention.

Further, the hammer drill according to this embodiment has a dust suction device for sucking dust generated during drilling operation on a workpiece. For the sake of convenience, with regard to the dust suction device, only a dust collecting passage 175 is shown in FIGS. 2 and 3. The dust suction device mainly includes a dust suction unit (not shown) which is mounted to the front end region of the body 103 and sucks dust generated by drilling operation, and the dust collecting passage 175 (see FIGS. 2 and 3) which is disposed within the motor housing 105 in order to transfer dust sucked by the dust suction unit.

The dust collecting passage 175 mainly includes a front pipe 176 having both ends open and extending within the motor housing 105 in a direction substantially parallel to the axial direction of the hammer bit 119, a rear pipe (or a flexible pipe) 177 connected to the front pipe 176 and a dust discharge port 178 formed in the lower connecting region of the handgrip 109. The front pipe 176 is disposed to extend in the longitudinal direction through a space above the output shaft 112 of the driving motor 111. A dust transfer part on the dust suction unit is connected to the front end opening of the front pipe 176, and the rear pipe 177 is connected to the rear end opening of the front pipe 176.

The rear pipe 177 connected to the front pipe 176 is disposed within the rear cover 108 of the motor housing 105 and extends downward behind a controller 155. A lower end of the rear pipe 177 is connected to one (front) connecting port of the pipe joint 169 of the assembly structure 161. Further, the dust discharge port 178 is formed in the lower connecting region 109C of the handgrip 109 and connected to a rear connecting port of the pipe joint 169 when the assembly structure 161 is mounted to the lower connecting region 109C. Further, a dust collecting hose 179 (as shown by two-dot chain line in FIGS. 2 and 3) of a dust collector is connected to the dust discharge port 178 when drilling operation is performed.

In this embodiment, the outer housing 102 covers the gear housing 107 including the barrel 106 or the upper region of the body 103. Specifically, the outer housing 102 is separated from the motor housing 105, and the motor housing 105 is exposed to the outside. With this construction, an area of a double housing structure is reduced, so that the external shape size of the hammer drill 101 is reduced.

Further, in this embodiment, the handgrip 109 is integrally formed with the outer housing 102 and the side grip 181 is mounted on the front end region of the outer housing 102. The upper connecting region 109B of the handgrip 109 is elastically connected to the gear housing 107 by the first compression coil spring 131 and the lower connecting region 109C is elastically connected to the rear cover 108 of the motor housing 105 by the second compression coil spring 165. Moreover, the front end of the outer housing 102 is elastically connected to the barrel 106 by the elastic ring 171. With such a construction, the outer housing 102, the handgrip 109 and the side grip 181 are supported such that they can move in the axial direction of the hammer bit 119 with respect to the body 103. Therefore, when the user holds the handgrip 109 and the side grip 181 and performs a hammering or hammer drill operation while pressing the hammer bit 119 against a workpiece, vibration is caused in the axial direction of the hammer bit 119, but transmission of such vibration to the handgrip 109 and the side grip 181 can be reduced by the first compression coil spring 131, the second compression coil spring 165 and the elastic ring 171.

In this embodiment, the first compression coil spring 131 which is disposed in the upper connecting region 109B close to the axis of the hammer bit 119 is designed to have a higher spring constant than the second compression coil spring 165 disposed in the lower connecting region 109C and thus have a relatively high spring stiffness. Therefore, the handgrip 109 is prevented from wobbling with respect to the body 103 in a direction transverse to the longitudinal direction, so that the operation of pressing the hammer bit 119 against the workpiece is performed with stability and usability of the impact tool is improved. Further, the stiff first compression coil spring 131 having a large spring constant is used in the upper connecting region to which large vibration is inputted and the soft second compression coil spring 165 having a small spring constant is used in the lower connecting region to which small vibration is inputted, so that vibration can be optimally prevented.

In this embodiment, the motor controlling controller 155 mounted on a fixed member of the driving motor 111 is housed within the rear cover 108 fastened to the motor housing 105, so that the controller 155 is integrated with the motor housing 105. In a construction, for example, in which the rear cover 108 is integrally formed with the outer housing 102, a space must be provided in the rear cover 108 in order to avoid the rear cover 108 from interfering with the controller 155 due to relative movement of the motor housing 105 and the outer housing 102. In this embodiment, however, with the above-described construction, it is not necessary to provide such a space in the rear cover 108, so that the impact tool can be correspondingly reduced in size.

Further, in this embodiment, the front and rear pipes 176, 177 forming the dust collecting passage 175 are housed within the motor housing 105 and the rear cover 108 and fastened to the motor housing 105 or the rear cover 108. In a construction, for example, in which the rear cover 108 is integrally formed with the outer housing 102, a space must be provided in the rear cover 108 in order to avoid the rear cover 108 from interfering with the front and rear pipes 176, 177 due to relative movement of the motor housing 105 and the outer housing 102. In this embodiment, however, with the above-described construction, it is not necessary to provide such a space in the rear cover 108, so that the impact tool can be reduced in size. Further, the front and rear pipes 176, 177 do not become misaligned with respect to each other, so that leakage of dust can be effectively prevented.

In this embodiment, the second compression coil spring 165 and the pipe joint 169 for the dust collecting passage 175 are mounted in advance in the assembly structure 161 as its components and then the assembly structure 161 is mounted between the lower connecting region 109C and the rear cover 108. Therefore, the second compression coil spring 165 and the pipe joint 169 can be easily mounted.

Figure 11:
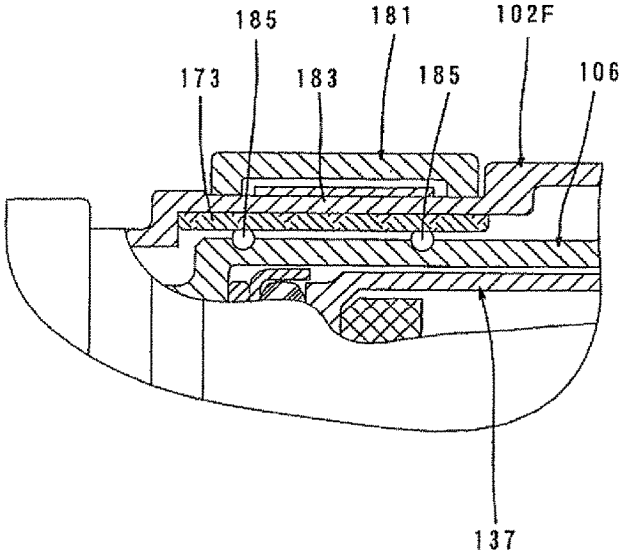
FIG. 11 is a partial sectional view showing a modification of an elastic ring.

In this embodiment, the elastic ring 171 has a plurality of the elastic receivers 171*a* in the circumferential direction and the openings 172 between the adjacent elastic receivers 171*a* are utilized as a cooling air passage, but an O-ring 185 as shown in FIG. 11 may be used in place of the elastic ring 171. Specifically, the O-ring 185 is disposed to be held in contact with both the outer peripheral surface of the barrel 106 and the inner peripheral surface of the outer housing 102 all around it in the circumferential direction. With such a construction, the space between the barrel 106 and the outer housing 102 is closed (sealed) in the longitudinal direction by the O-ring 185 such that dust or the like can be prevented from entering the space from the outside.

Further, in this embodiment, the elastic receivers 171*a* arranged at predetermined intervals in the circumferential direction are connected to each other into a ring form, but the elastic receivers 171*a* may be arranged separately from each other in the circumferential direction. Further, in this embodiment, the first compression coil spring 131 has a spring constant larger than the second compression coil spring 165. However, in place of such a construction, the first compression coil spring 131 and the second compression coil spring 165 may have the same specifications, and the first compression coil spring 131 may be mounted under a heavier initial load than the second compression coil spring 165 (in the state in which the coil spring is compressed by application of a load in the direction of compression in a stationary condition).

Further, in this embodiment, the hammer drill is explained as a representative example of the impact tool, but this invention may be applied to a hammer which causes the hammer bit 119 to perform only a striking movement in the axial direction.

In view of the above-described invention, the following aspects can be provided, Aspect 1:

"The impact tool as defined in claim 1, wherein the handle is integrally formed with the outer shell housing."

Aspect 2:

"The impact tool as defined in claim 1 or (1), wherein the outer shell housing is split into front and rear housing parts in the axial direction of the tool bit and the front and rear housing parts are integrally connected together."

Aspect 3:

"The impact tool as defined in any one of claims 5 and 6 or (1) and (2), wherein the third elastic element connects the outer shell housing front end region and the tool body front end region such that the outer shell housing front end region and the tool body front end region can move with respect to each other in a direction transverse to the axial direction of the tool bit."

Aspect 4:

"The impact tool as defined in claim 5 or (3), wherein the third elastic element comprises an O-ring."

Aspect 5:

"The impact tool as defined in claim 6, wherein an opening is formed between adjacent ones of the elastic receivers and spaces between an outer peripheral surface of the tool body and an inner peripheral surface of the outer shell housing communicate with each other in the axial direction of the tool bit via the opening, and the opening forms a cooling air passage through which air taken in through the front end region of the outer shell housing is led rearward."

DESCRIPTION OF NUMERALS

101 hammer drill
102 outer housing (outer shell housing)
102F front housing part
102R rear housing part
103 body (tool body)
105 motor housing
106 barrel
107 gear housing
108 rear cover
108*a* screw
109 handgrip (handle)
109A grip region
109B upper connecting region (first handle end portion)
109C lower connecting region (second handle end portion)
109*a* trigger
111 driving motor (motor)
112 output shaft (rotation axis)
113 motion converting mechanism (striking mechanism part)
115 striking mechanism (striking mechanism part)
117 power transmitting mechanism
119 hammer bit (tool bit)
121 screw
121*a*, 121*b* connecting boss
123 slide guide
124 cylindrical guide
125 guide rod
126 screw
127 fixed member
128 screw
129 piston
131 first compression coil spring (first elastic element)
133 spring receiver
135 spring receiver
137 tool holder
141 cylinder
143 striker
145 impact bolt
151 slide guide
152 guide rod
153 cylindrical guide
154 screw
155 controller
157, 158 mounting opening
161 assembly structure
162 front plate (plate-like member)
162*a* cylindrical spring receiver
162*b* hole
163 rear plate (plate-like member)
163*a* cylindrical spring receiver
164 bellows-like member (connecting member)
165 second compression coil spring (second elastic element)
167 engagement arm
167*a* engagement claw
169 pipe joint (opening)
169*a*, 169*b* front and rear cylindrical part
169*c* sleeve
171 elastic ring (third elastic element)
171*a* elastic receiver
172 opening (cooling air passage)
173 sleeve
175 dust collecting passage
176 front pipe
177 rear pipe
178 dust discharge port
179 dust collecting hose
181 side grip (auxiliary handle)
183 side grip mounting part (auxiliary handle mounting part)
185 O-ring

The invention claimed is:

1. An impact tool comprising:

a striking mechanism part that strikes a tool bit in an axial direction of the tool bit, a motor that drives the striking mechanism part and is disposed such that a rotation axis of the motor runs transversely to the axial direction of the tool bit, a tool body having a first portion that houses the motor and a second portion that houses the striking mechanism part, the tool body having a front end region to which the tool bit is coupled and a rear end region, the front end region of the tool body being closer to the tool bit, in the axial direction, than the rear end region of the tool body, an outer shell housing that covers the second portion of the tool body, the outer shell housing having a front end region and a rear end region, the front end region of the outer shell housing being closer to the tool bit than the rear end region of the outer shell housing in the axial direction, the front end region of the outer shell housing having a bottom that is open other than at a front end of the bottom, the bottom being spaced from the rotation axis in a direction transverse to the axial direction and facing the first portion of the tool body, the first portion of the tool body extending from the bottom of the front end region of the outer shell housing in the transverse direction, a handle that is designed to be held by a user and integrally formed with the outer shell housing on a side opposite from the tool bit and extends transversely to the axial direction of the tool bit, a first handle end portion formed on a first extending end of the handle, a second handle end portion formed on a second extending end of the handle opposite to the first extending end, a first elastic element that is disposed between the first handle end portion and the tool body and connects the first handle end portion and the tool body such that the first handle end portion and the tool body can move in the axial direction of the tool bit with respect to each other, a second elastic element that is disposed between the second handle end portion and the tool body and connects the second handle end portion and the tool body such that the second handle end portion and the tool body can move in the axial direction of the tool bit with respect to each other, an auxiliary handle directly coupled with an outer surface of the outer shell housing front end region, and a third elastic element extending about an outer circumference of the tool body front end region between an inner peripheral surface of the outer shell housing front end region and the outer circumference of the tool body front end region such that the outer shell housing front end region and the tool body can move with respect to each other, thereby reducing vibration transmitted from the tool body front end region to the auxiliary handle, wherein the outer circumference defines a circumferential plane that is orthogonal to the axial direction of the tool bit, wherein the first portion of the tool body that houses the motor is exposed to an outside of the impact tool, wherein the outer shell housing, the handle, and the auxiliary handle are integrally formed, and wherein the integrally formed outer shell housing, handle, and auxiliary handle are elastically connected with and movable relative to the second portion of the tool body and the first portion of the tool body that houses the motor.

2. The impact tool as defined in claim 1, wherein the third elastic element comprises a plurality of elastic receivers which are disposed at predetermined intervals in a circumferential direction and held in contact with the inner peripheral surface of the outer shell housing front end region and the outer circumference of the tool body front end region.

3. The impact tool as defined in claim 1, wherein the outer shell housing covers only the second portion of the tool body entirely along the striking mechanism part in a longitudinal direction of the striking mechanism part.

4. The impact tool as defined in claim 1, wherein the third elastic element includes one or more elastic members that extend about a circumference of the second portion of the tool body.

5. The impact tool as defined in claim 1, wherein the auxiliary handle is coupled with the outer surface of the outer shell housing front end region by a side grip mounting part, the third elastic element being disposed between the auxiliary handle and the outer circumference of the tool body front end region in the circumferential plane.

* * * * *